US005929820A

United States Patent [19]

Caulfield et al.

[11] Patent Number: 5,929,820

[45] Date of Patent: Jul. 27, 1999

[54] SCANNING CUP-DIPOLE ANTENNA WITH FIXED DIPOLE AND TILTING CUP

[76] Inventors: Michael F. Caulfield, 705 E. Maple Ave., El Segundo, Calif. 90245; Frank Boldissar, 2836 Pickard Ave., Redondo Beach, Calif. 90278; Barry J. Forman, 2204 Pine Ave., Manhattan Beach, Calif. 90266; Roy J. Virkler, 1281 So. Citrus Ave., Los Angeles, Calif. 90019; Mark A. Schalit, 217 43rd St., Manhattan Beach, Calif. 90266

[21] Appl. No.: 08/524,734

[22] Filed: Sep. 6, 1995

Related U.S. Application Data

[63] Continuation of application No. 08/191,345, Feb. 2, 1994, abandoned.

[51] Int. Cl.[6] ..... H01Q 3/12; H01Q 21/26

[52] U.S. Cl. ..... 343/761; 343/797; 343/839

[58] Field of Search ..... 343/761, 789, 343/797, 821, 839; H01Q 21/26, 1/42

[56] References Cited

U.S. PATENT DOCUMENTS

| | | | |
|---|---|---|---|
| 2,539,657 | 1/1951 | Carter | 343/761 |
| 2,759,182 | 8/1956 | Chaffee | 343/838 |
| 3,518,687 | 6/1970 | Pocs | 343/761 |
| 3,740,754 | 6/1973 | Epis | 343/789 |
| 4,668,956 | 5/1987 | Mahnad | 343/789 |

FOREIGN PATENT DOCUMENTS 2581257 10/1986 France .

1441608 1/1970 Germany .

OTHER PUBLICATIONS

Ehrenspeck et al., "Short–Backfire Antenna–A High Efficiency Array Element", Microwave Journal, May 1977, pp. 47–49, (343/797).

*Primary Examiner*—Michael C. Wimer
*Attorney, Agent, or Firm*—Terje Gudmestad; Georgann Grunebach; Michael W. Sales

[57] ABSTRACT

Antenna apparatus having a fixed dipole and a rotating cup. The cup is formed from a cylindrical conductor shorted at its base to a conducting plate. The fixed dipole is recessed within the cup and has a coaxial transmission line feed that penetrates through a base plate of the cup and is coupled to the dipole. The present invention achieves beam scanning by mechanically rotating only the cup, and wherein the dipole and feed remain fixed. The antenna may further comprise a second fixed dipole oriented orthogonal to the fixed dipole. The dipole feed may be a hybrid coupler network coupled by way of a plurality of coaxial transmission line feeds and a four-post balun to the fixed dipoles. The first and second crossed dipoles lie in a plane that is generally orthogonal to a central axis of the antenna. In an alternative embodiment, the dipole feed may be a turnstile, crossed-dipole feed. In another embodiment, a transmission line feed is directly coupled to a crossed dipole having asymmetrical arms. The antenna may also embody an array of symmetrical dipoles. The dipoles of any of the disclosed antennas may be scaled for any frequency.

19 Claims, 2 Drawing Sheets

SCANNING CUP-DIPOLE ANTENNA WITH FIXED DIPOLE AND TILTING CUP

CROSS REFERENCE TO RELATED APPLICATIONS

This application is a continuation of U.S. patent application Ser. No. 08/191,345, filed Feb. 2, 1994, now abandoned.

This invention was made with Government support under a contract awarded by an agency of the United States Government. The Government has certain rights in this invention.

BACKGROUND

The present invention relates generally to antennas, and more particularly, to scanning cup-dipole antenna(s) having a fixed dipole(s) and a rotating cup.

Conventional cup-dipole antennas have been used extensively to provide high aperture efficiency for small antenna apertures that span approximately one wavelength. The cup is formed from a cylindrical conductor shorted at its base with a conducting plate. A dipole is recessed within the cup and has a coaxial transmission line penetrating the base of the cup. A conventional method for achieving a scanned beam is to rotate the dipole and cup assembly as a single unit, necessitating the use of an RF joint such as a flexible coaxial cable or a rotary joint. However, conventional RF joints, particularly rotary joints, are very expensive to design and manufacture. RF joints present a reliability concern for long-life spacecraft, and are susceptible to passive intermodulation (PIM) generation and multipaction for space applications. RF joints are generally massive and clumsy to package, and produce undesirable Ohmic loss and reflections. Thus, conventional antennas do not employ rotation of the cup while the dipole/feed assembly remains fixed. As a consequence, an RF joint has been required with its inherent disadvantages mentioned above.

A better understanding of Conventional cup-dipole antennas may be had from a reading of a book entitled "Microwave Cavity Antennas", by A. Kunar and H. D. History, published by Artech House, Boston (1989). Specific reference is made to Chapter 5 which discusses various conventional cup-dipole antennas.

Accordingly, it is an objective of the present invention to provide for improved scanning cup-dipole antenna(s) having a fixed dipole(s) and a rotating cup.

SUMMARY OF THE INVENTION

The present invention provides for improved scanning cup-dipole antennas having a fixed dipole, or dipoles, and a rotating cup. The cup is formed from a cylindrical conductor shorted at its base to a conducting plate. A dipole is recessed within the cup and has a coaxial transmission line that penetrates through the base of the cup and is coupled to the dipole. The present invention achieves beam scanning in a novel way by mechanically rotating only the cup, and wherein the dipole and feed assembly remain fixed.

A plurality of dipoles may be disposed within the cup in a symmetrical array, and wherein the dipoles are scaled for any desired frequency. The present antennas support transmission of linear or circular polarized energy. By using a hybrid coupler and symmetrical dipole arms, circular polarized energy may be radiated. Also, circularly polarized energy may be radiate without the use of the hybrid coupler, by employing asymmetrical dipole arms.

More specifically, the present invention is a scanning cup-dipole antenna comprising a fixed dipole, a dipole feed coupled to the fixed dipole, a rotatable antenna cup disposed around the fixed dipole, and a gimbal coupled to the antenna cup that is adapted to rotate the antenna cup relative to the fixed dipole. The antenna may further comprise a second fixed dipole oriented orthogonal to the fixed dipole. In one embodiment, the dipole feed may be comprised of a hybrid coupler network coupled by way of a plurality of coaxial transmission line feeds and a four-post balun to the fixed dipoles. A short-circuit ring is disposed around the periphery of the four-post balun, and is disposed in an axially-located opening in a cup base plate. The antenna cup is comprised of the conducting cup base plate and a cylindrical cup rim coupled thereto. The first and second crossed dipoles lie in a plane that is generally orthogonal to a central axis of the antenna. In an alternative embodiment, the dipole feed may be comprised of a turnstile, crossed-dipole feed. In another embodiment, the dipole feed may be coupled by way of a coaxial transmission line feed to single fixed linearly polarized dipole.

Because the rotating cup is detached from the dipole and feed assembly, a radio frequency (RF) joint (e.g., rotary joint or flexible transmission line) is not required. For high-power applications, the present invention is therefore less expensive to design and manufacture than conventional antennas, it is more reliable, it is not susceptible to passive intermodulation (PIM) generation and multipaction in space applications, and it does not produce undesirable Ohmic loss or reflections.

The present invention may be adapted for use as a high-power transmit antenna for a satellite, for example. The present invention provides beam scanning from a device that is aperture efficient, light weight, reliable, and inexpensive to manufacture.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
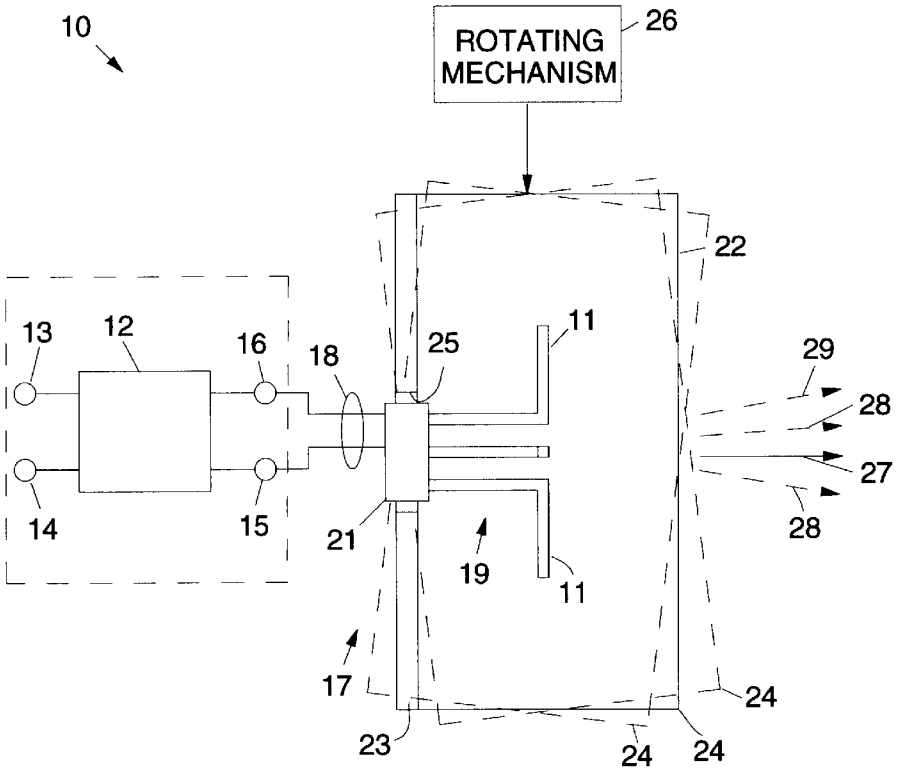
FIG. 1 is a cross sectional view illustrating several embodiments of a scanning cup-dipole antenna having a fixed dipole and a rotating cup in accordance with the principles of the present invention.

Referring to the drawing figures, FIG. 1 is a cross sectional view illustrating several embodiments of a scanning cup-dipole antenna 10 in accordance with the principles of the present invention. The scanning cup-dipole antenna 10 has a fixed dipole 11 (or dipoles 11) and a rotating antenna cup 22. In one embodiment, the scanning cup-dipole antenna 10 is comprised of a (3 dB) hybrid coupler network 12 that includes electrically isolated right-hand and left-hand circular polarization ports 13, 14 and first and second hybrid output ports 15, 16. The first and second hybrid output ports 15, 16 of the hybrid coupler network 12 are coupled to a dipole feed 17. The dipole feed 17 is comprised of a plurality of coaxial transmission line feeds 18 and a four-post balun 19. The plurality of coaxial transmission line feeds 18 are coupled between the first and second hybrid output ports 15, 16 and the four-post balun 19. A short-circuit ring 21 is disposed around the periphery of a portion of the four-post balun 19. The four-post balun 19 is coupled to first and second crossed dipoles 11 that lie in a plane that is orthogonal to a central axis of the antenna 10. However, it is to be understood that a single dipole 11 may be employed in the antenna 10 that is used for generating a single polarization.

The antenna cup 22 is comprised of a conducting cup base plate 23 and a cylindrical cup rim 24. The short-circuit ring 21 is disposed in an axially-located opening 25 in the cup base plate 23. The cup 22 (shown in solid outline) is concentric to a feed axis of the dipoles 11. An antenna rotating mechanism 26 is coupled to the antenna cup 24 that is adapted to rotate the antenna cup 24 along a selected axis or set of axes, that is generally orthogonal to the axis of the antenna 10. A non-scanning cup axis 27 of the antenna 10 is designated by the solid arrow. A first dashed arrow shows a scanning axis 28 of the cup 24 when the antenna 10 is scanned. Also, a second dashed arrow shows a direction of the peak gain 29 of the antenna 10. The antenna cup 24 the also shown disposed in a second orientation illustrated by the dashed cup 24 shown in FIG. 1.

Figure 2:
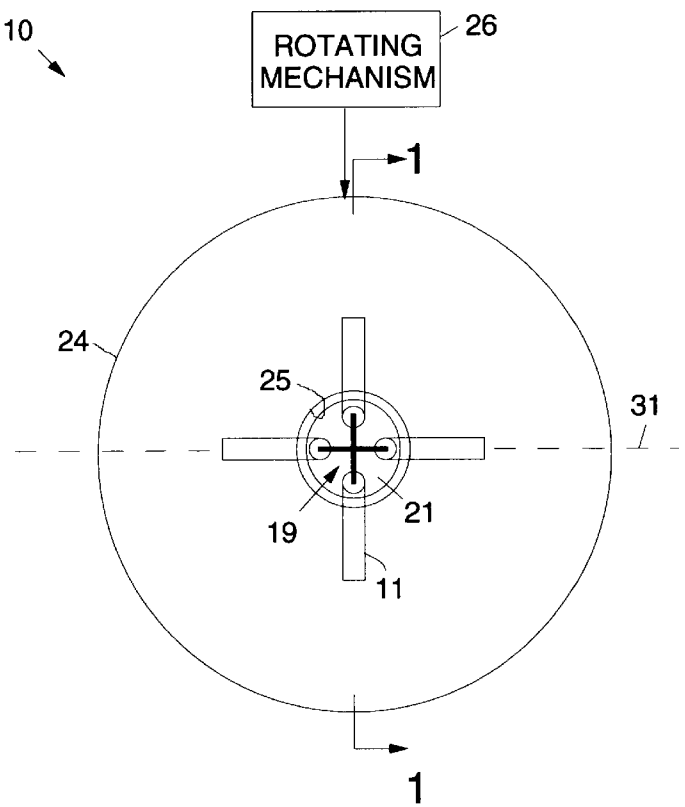
FIG. 2 shows an end view of the antenna of FIG. 1.

FIG. 2 shows an end view of the antenna 10 of FIG. 1 and shows the short-circuit ring 21, the four-post balun 19, the first and second crossed dipoles 11, the opening 25 in the cup base plate 23, and the cup rim 24 with more clarity. A first plane of rotation 31 is shown in FIG. 2 that is generally along a line parallel to a first crossed dipole 11. The antenna 10 may also be rotated along a second direction that is generally orthogonal to the first plane of rotation 31 and that is along a line parallel to the second crossed dipole 11.

The use of the crossed dipoles 11 and the hybrid coupler 12, for example, permit dual circular polarizations to be radiated by the antenna 10 by feeding the two electrically isolated right-hand and left-hand circular polarization ports 13, 14. If so desired, and in the alternative, a single dipole 11 fed by a single coaxial transmission line feed 18 may be disposed in the rotating cup 22 to achieve a scanned, linearly polarized beam.

The cup 22 shown in solid outline in FIG. 1 is concentric with the axis of the dipole feed 17, which produces a far-field antenna pattern having peak gain 29 in the direction of the feed axis of the dipoles 11. The cup 22 shown in phantom (dashed outline) is rotated, leaving the dipole feed 17 and hybrid coupler network 12 fixed in space. Mechanical rotation of the cup 22 results in scanning of the antenna beam pattern.

The hybrid coupler network 12 is not required in all configurations of the scanning cup-dipole antenna 10, which is illustrated by the dashed box surrounding it. Thus the transmission line feeds 18 are directly coupled from the input ports to the four-post balun 19. Elimination of the hybrid coupler network 12 produces a second embodiment of the scanning cup-dipole antenna 10. Furthermore, and as is illustrated with reference to the elongated dipole 11 having the dashed outline, the single dipole 11 may be disposed in the rotating cup 22 that is may be fed by a single coaxial transmission line feed 18 to achieve a scanned, linearly polarized beam. This produces a third embodiment of the scanning cup-dipole antenna 10. It is to be understood that the dipoles 11 employed in any of the disclosed embodiments may be scaled for any desired frequency. The present invention may be implemented to generate circular polarization without using the hybrid coupler network 12 by using a dipole feed 17 comprising a turnstile, crossed-dipole feed 17. The turnstile, crossed-dipole feed 17 replaces the hybrid coupler network 12 and the crossed dipole feed 17 of FIG. 1.

Figure 3:
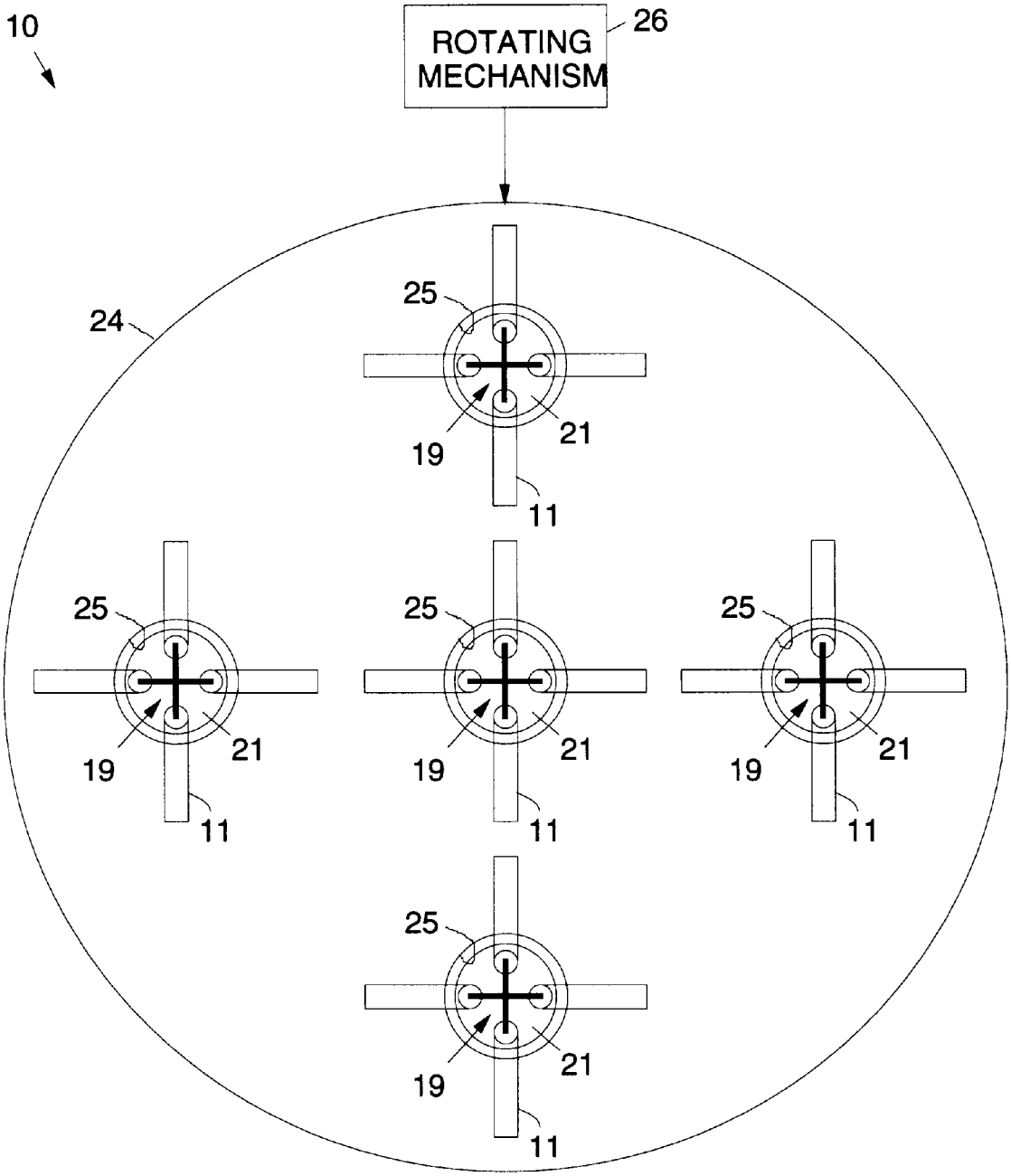
FIG. 3 shows an embodiment of the present antenna comprising an array of dipoles.

For the purposes of completeness, FIG. 3 shows an embodiment of the present antenna comprising an array of dipoles. A plurality of dipoles 11 are disposed within the cup 22 in a symmetrical array.

A breadboard antenna 10 was built and tested to demonstrate the scanning capabilities of the present invention. The breadboard antenna 10 used the embodiment of FIG. 1 comprising two crossed dipoles 11 and the hybrid coupler network 12 to generate circular polarization. It was found that the antenna pattern scanned in the direction of the axis of the rotated cup 22 with minimal degradation in pattern gain 29 and axial ratio.

Thus there has been described new and improved scanning cup-dipole antenna(s) having a fixed dipole(s) and a rotating cup. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A scanning cup-dipole antenna having a central longitudinal axis, comprising:

a fixed dipole disposed orthogonal to the central longitudinal axis of the antenna;

a dipole feed coupled to the fixed dipole;

a rotatable antenna cup disposed around the fixed dipole that has an axis of rotation that lies in a plane that is orthogonal to the central longitudinal axis of the antenna and that is either substantially parallel to or substantially perpendicular to the fixed dipole, and wherein the antenna cup is rotatable around the axis of rotation, said cup having a cup base plate and a cylindrical cup rim extending in an axial direction from said cup base plate; and antenna rotating apparatus coupled to the antenna cup for rotating the antenna cup relative to the fixed dipole around the axis of rotation.

2. The antenna of claim 1 further comprising a second fixed dipole oriented substantially orthogonal to the fixed dipole.

3. The antenna of claim 2 wherein the dipole feed is comprised of a hybrid coupler network coupled by way of a plurality of coaxial transmission line feeds and a four-post balun to the fixed dipole.

4. The antenna of claim 3 wherein the hybrid coupler network is comprised of electrically isolated right-hand and left-hand circular polarization input ports and first and second hybrid output ports coupled to the coaxial transmission line feeds.

5. The antenna of claim 3 further comprising a short-circuit ring disposed around the periphery of the four-post balun.

6. The antenna of claim 2 wherein the dipoles lie in a plane that is orthogonal to a central axis of the antenna.

7. The antenna of claim 1 further comprising a short-circuit ring disposed in an axially-located opening in the cup base plate.

8. The antenna of claim 2 wherein the dipole feed is comprised of a turnstile, crossed-dipole feed.

9. The antenna of claim 2 further comprising an array of dipoles disposed in the antenna cup.

10. The antenna of claim 9 wherein the array of dipoles are symmetrically disposed in the antenna cup.

11. The antenna of claim 9 wherein the array of dipoles are asymmetrically disposed in the antenna cup.

12. A scanning cup-dipole antenna having a central longitudinal axis, comprising:

a fixed plurality of crossed dipoles that lie in a plane that is orthogonal to the central longitudinal axis of the antenna;

a dipole feed having first and second input ports, and having first and second output ports coupled to the fixed plurality of crossed dipoles;

a rotatable antenna cup disposed around the fixed plurality of crossed dipoles that has an axis of rotation that lies in a plane that is orthogonal to the central longitudinal axis of the antenna and that is substantial ly parallel to a selected fixed dipole of the plurality of crossed dipoles, and wherein the antenna cup is rotatable around the axis of rotation said cup having a cup base plate and a cylindrical cup rim extending in an axial direction from said cup base plate; and antenna rotating apparatus coupled to the antenna cup for rotating the antenna cup relative to the fixed plurality of crossed dipoles around the axis of rotation.

13. The antenna of claim 12 wherein the dipole feed is comprised of a hybrid coupler network, a four-post balun, and a plurality of coaxial transmission line feeds coupled between the hybrid coupler network and the four-post balun.

14. The antenna of claim 13 further comprising a short-circuit ring disposed around the periphery of the four-post balun.

15. The antenna of claim 12 wherein the fixed plurality of crossed dipoles comprise first and second crossed dipoles that lie in a plane that is orthogonal to a central axis of the antenna.

16. The antenna of claim 14 wherein the short-circuit ring is disposed in a axially-located opening in the cup base plate.

17. The antenna of claim 12 further comprising an array of dipoles disposed in the antenna cup.

18. The antenna of claim 17 wherein the array of dipoles are symmetrically disposed in the antenna cup.

19. The antenna of claim 17 wherein the array of dipoles are asymmetrically disposed in the antenna cup.

* * * * *